US008641027B2

(12) United States Patent
Koskela et al.

(10) Patent No.: US 8,641,027 B2
(45) Date of Patent: Feb. 4, 2014

(54) TURNTABLE

(75) Inventors: Janne Koskela, Turku (FI); Pavel Basharanov, Kardjali (BG)

(73) Assignee: Oy M. Haloila AB, Masku (FI)

( * ) Notice: Subject to any disclaimer, the term of this patent is extended or adjusted under 35 U.S.C. 154(b) by 350 days.

(21) Appl. No.: 13/123,959

(22) PCT Filed: Oct. 16, 2009

(86) PCT No.: PCT/IB2009/054566

§ 371 (c)(1),
(2), (4) Date: Apr. 13, 2011

(87) PCT Pub. No.: WO2010/044077

PCT Pub. Date: Apr. 22, 2010

(65) Prior Publication Data

US 2011/0198792 A1 Aug. 18, 2011

(30) Foreign Application Priority Data

Oct. 17, 2008 (FI) ..... 20085983

(51) Int. Cl.
*B23Q 1/64* (2006.01)
*B60S 13/02* (2006.01)
*B65B 11/04* (2006.01)

(52) U.S. Cl.
USPC ..... 269/57; 104/44; 53/587; 53/211

(58) Field of Classification Search
USPC ..... 269/56, 57, 289 R; 104/44, 45, 99; 108/94, 104, 103, 139; 53/587, 211, 53/588, 461; 248/349.1
See application file for complete search history.

(56) References Cited

U.S. PATENT DOCUMENTS

| | | | | |
|---|---|---|---|---|
| 4,578,923 | A * | 4/1986 | Petterson | 53/211 |
| 4,753,173 | A * | 6/1988 | James | 104/45 |
| 5,131,209 | A | 7/1992 | Schreiber et al. | |
| 5,758,468 | A | 6/1998 | Focke et al. | |
| 2005/0016135 | A1 | 1/2005 | Heikaus | |

FOREIGN PATENT DOCUMENTS

| | | | |
|---|---|---|---|
| CN | 1148020 | A | 4/1997 |
| CN | 1572656 | A | 2/2005 |
| CN | 200986916 | A | 12/2007 |

(Continued)

OTHER PUBLICATIONS

Finnish Search Report for FI20085983 dated Aug. 26, 2009.

(Continued)

*Primary Examiner* — Lee D Wilson
*Assistant Examiner* — Jamal Daniel
(74) *Attorney, Agent, or Firm* — Lowe Hauptman & Ham, LLP

(57) ABSTRACT

A turntable for a wrapping machine for rotating an article to be wrapped up, the turntable including a rotatable round cover plate comprising two grooves in parallel with each other and arranged at a distance from each other that corresponds to the distance between the forks of the lifting fork of a pallet truck, wherein the grooves extend from the edge of the cover plate on both sides of the diameter of the cover plate and in parallel to the diameter, and wherein the grooves are adapted to receive the forks of the lifting fork so that the article to be wrapped up can be conveyed by the pallet truck onto the cover plate to be supported by it, and respectively off the cover plate.

20 Claims, 7 Drawing Sheets

(56) References Cited

FOREIGN PATENT DOCUMENTS

Figure 1:
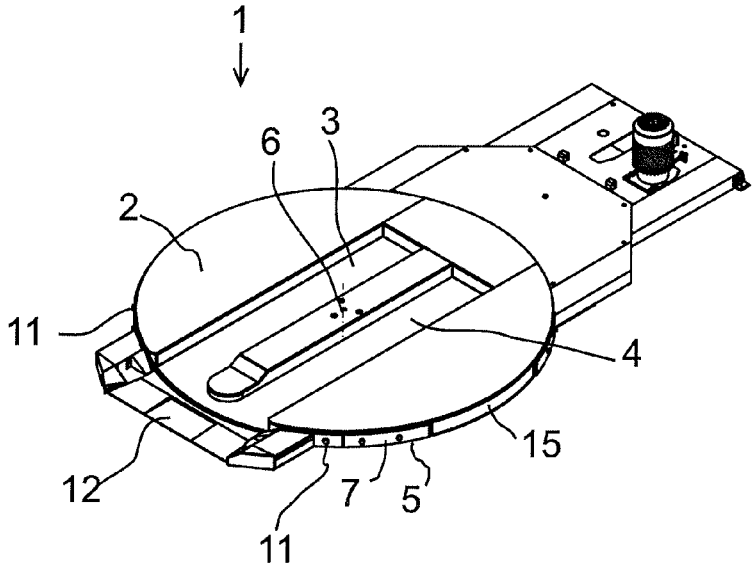

| | | | |
|---|---|---|---|
| DE | 19607084 | A1 | 8/1997 |
| EP | 0086045 | A2 | 8/1983 |
| FR | 2670747 | A1 * | 6/1992 |
| GB | 2113645 | A | 8/1983 |
| WO | 0236433 | A1 | 5/2002 |
| WO | WO 2009047620 | A2 * | 4/2009 |

OTHER PUBLICATIONS

ISR for PCT/IB2009/054566 dated Mar. 17, 2010.

* cited by examiner

TURNTABLE

RELATED APPLICATIONS

The present application is national phase of PCT/IB2009/054566 filed Oct. 16, 2009, and claims priority from Finnish Application Number 20085983 filed Oct. 17, 2008.

FIELD OF THE INVENTION

The invention relates to a turntable for a wrapping machine as defined in the preamble of claim 1.

BACKGROUND OF THE INVENTION

Known from the prior art are wrapping machines comprising a turntable for rotating an article to be wrapped up. The turntable comprises a rotatable round cover plate provided with two grooves in parallel with each other. The grooves are arranged at a distance from each other that corresponds to the distance between the forks of the lifting fork of a pallet truck. The grooves extend from the edge of the cover plate on both sides of the diameter of the cover plate and in parallel to the diameter. They receive the forks of the lifting fork so that the article to be wrapped up can be conveyed by the pallet truck onto the cover plate to be supported by it, and respectively off the cover plate. The rotatable cover plate is bearing-mounted to a fixed base plate which is supported to a fixed base, so as to rotate about a central vertical rotating axis. Extending up substantially perpendicularly from the periphery of the base plate is a vertical wall. The vertical wall comprises an opening for an access ramp. The access ramp is fitted in alignment with the opening and mounted to the vertical wall. The forks of the pallet truck may be conveyed into the grooves of the cover plate through the access ramp.

A problem with the known wrapping machine turntables is that they are designed in such manner that the access ramp is mounted fixedly to the base plate and directed in a specific direction, selected by the manufacturer, which cannot be changed later by the user.

A further problem concerning the manufacturing technique is that, as said vertical wall which extends for most of the extent of the periphery of the base plate is mounted to the base plate by welding, the base plate is subject to distortions due to the welding, bringing about irregularities which make the gap between the base plate and the cover plate smaller and augment the operating noise as the cover plate is supported to the base plate by rollers which roll over the surface of the cover plate.

Typically, the manufacturers provide a number of different wrapping machine models designed specifically for a desired approach direction. Thus, the wrapping machine manufacturer must hold in production and in store many different turntables and their parts, which is not cost-effective.

OBJECTIVE OF THE INVENTION

The objective of the invention is to eliminate the drawbacks referred to above.

Specifically, the objective of the invention is to disclose a turntable for a wrapping machine wherein the delivery direction of the article to be conveyed to the turntable by a pallet truck may be selected according to the user's needs and changed, where necessary, to another delivery direction as desired.

A further objective of the invention is to disclose a turntable wherein the structure of the turntable may always be the same, irrespective of the delivery direction selected by the user.

Another objective of the invention is to reduce the need of welding of the base plate to reduce deformation of the base plate, so that the base plate will stay straight, the operating noise will be reduced, and a sufficiently large gap will be maintained between the base plate and the cover plate.

SUMMARY OF THE INVENTION

The turntable according to the invention is characterized by what has been presented in claim 1.

According to the invention, the vertical wall comprises at least two openings, directed from the rotating axis radially in different directions relative to each other, to fit the access ramp selectively in alignment with at least one of the openings to selectively determine the approach direction of the pallet truck.

The advantage of the invention is that the delivery direction of the article to be conveyed to the turntable by a pallet truck may be selected according to the user's needs, and be further changed, where necessary, to another delivery direction as desired.

Another advantage of the invention is that the structure of the turntable may always be the same, irrespective of the delivery direction selected by the user. This facilitates and enhances manufacturing of the wrapping machines. The number of different parts required is reduced, which enhances cost-effectiveness in the manufacturing.

A further advantage of the invention is that, as the vertical wall is mounted to the base plate by welding, the required length of the welding over the extent of the periphery of the base plate is reduced, thanks to the discontinuities, i.e. the openings, of the vertical wall, whereupon the deformations of the base plate are reduced as well. As a consequence, the base plate stays straighter than before, which reduces the operating noise and secures a sufficient gap between the base plate and the table plate.

In one embodiment of the turntable, the vertical wall comprises three openings.

In one embodiment of the turntable, the turntable comprises two access ramps.

In one embodiment of the turntable, the turntable comprises three access ramps.

In one embodiment of the turntable, the angle between the radii which extend from the rotating axis through the midpoints of the adjacent openings is about 90°.

In one embodiment of the turntable, the turntable comprises detachably mountable cover wall sections which may be fitted to cover that or those openings, which is/are currently not aligned with an access ramp.

In one embodiment of the turntable, the vertical wall comprises fixing members, such as bolt holes for bolt fixing, on both sides of the opening. The cover wall section and the access ramp comprise corresponding fixing members, such as bolt holes for bolt fixing, fitted in alignment with the first-mentioned fixing members.

In one embodiment of the turntable, the periphery of the rotatable cover plate comprises a skirt flange extending down from the level of the cover plate in a substantially vertical direction. The skirt flange that rotates along with the cover plate is disposed in the interior of and is covered by the fixed vertical wall and the optional cover wall sections mounted to the vertical wall.

LIST OF FIGURES

Figure 11:
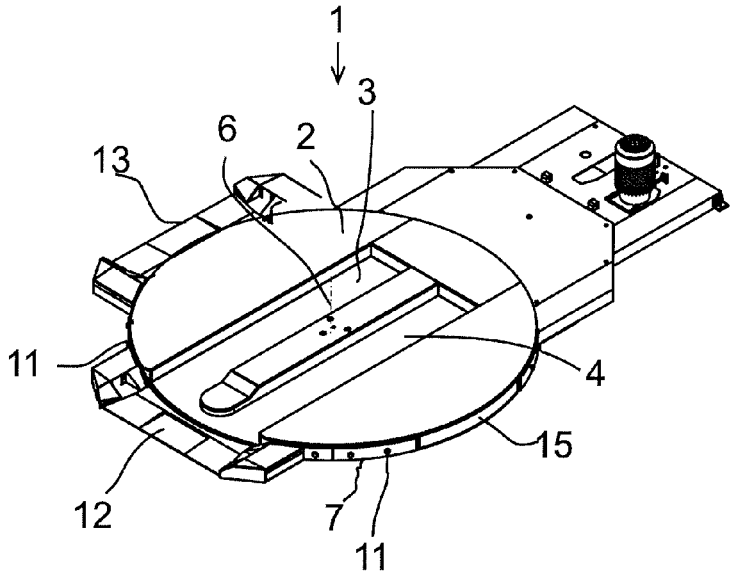
Figure 12:
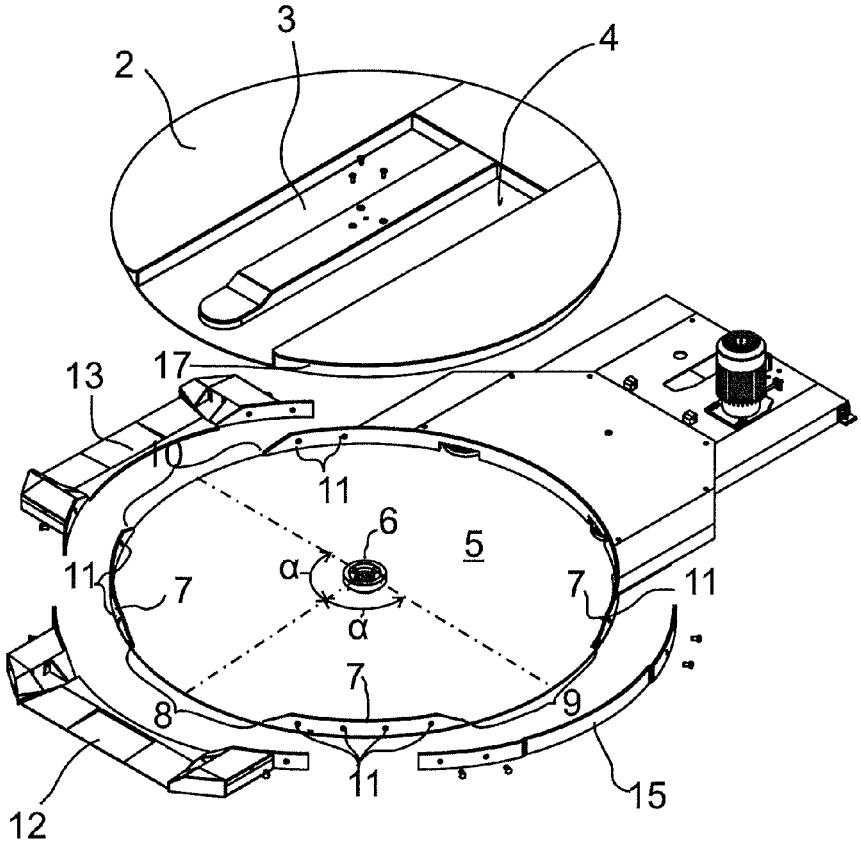
Figure 13:
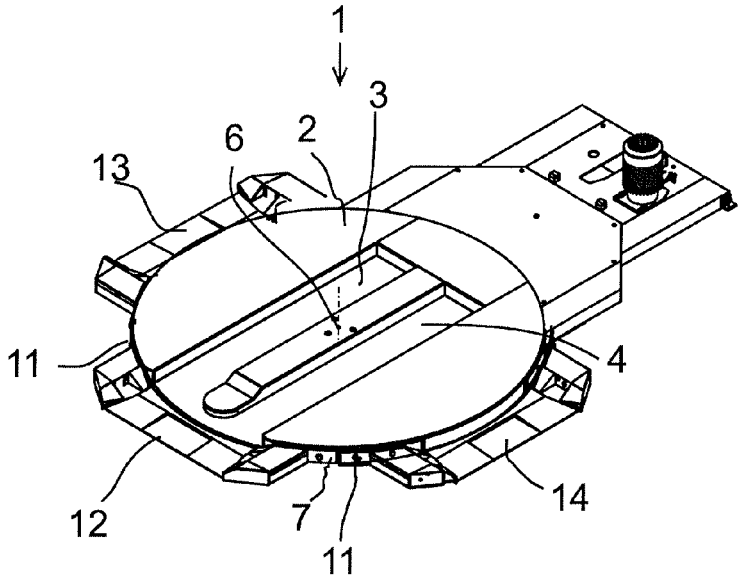
Figure 14:
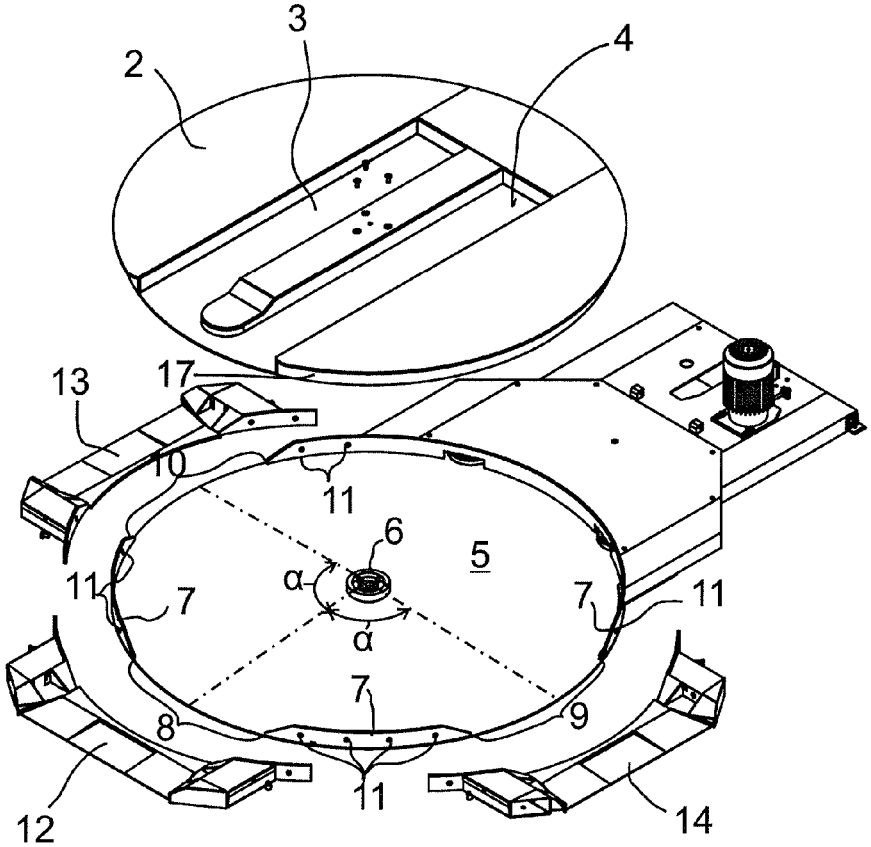

In the following section, the invention will be described in detail with examples of its embodiments and referring to the accompanying drawing in which FIG. 1 to 6 represent embodiments of the turntable according to the invention as seen obliquely from above in assembled configurations (FIG. 1, 3, 5) and as exploded views (FIG. 2, 4, 6), wherein the embodiments comprise one access ramp which may be mounted in three different ways, FIG. 7 to 12 represent embodiments of the turntable according to the invention as seen obliquely from above in assembled configurations (FIG. 7, 9, 11) and as exploded views (FIG. 8, 10, 12), wherein the embodiments comprise two access ramps which may be mounted in three different ways, and FIGS. 13 and 14 represent an embodiment of the turntable according to the invention as seen obliquely from above in an assembled configuration (FIG. 13) and as an exploded view (FIG. 14), wherein the embodiment comprises three access ramps.

DETAILED DESCRIPTION OF THE INVENTION

FIG. 1 to 14 show part of a wrapping machine. The figures do not show the conventional tower body in which a film delivery device moves vertically, because this invention does not relate to such features.

All turntables represented in FIG. 1 to 14 have the same basic structure.

The turntable comprises a rotatable round cover plate 2 provided with two grooves 3, 4 in parallel with each other. The grooves 3, 4 are arranged at a distance from each other that corresponds to the distance between the forks of the lifting fork of a pallet truck. The grooves 3, 4 extend from the edge of the cover plate 2 on both sides of the diameter of the cover plate and in parallel to the diameter. The grooves 3, 4 are fitted to receive the forks of the lifting fork so that the article to be wrapped up can be conveyed by the pallet truck through the grooves onto the cover plate to be supported by it, and respectively off the cover plate. In accordance with that described in Finnish patent application FT 20075717 by the same applicant, the grooves 3, 4 preferably comprise bottoms which form an integral structural part of the turntable 1 which has a substantially rigid, self-supporting structure, so that the bottoms support the lifting fork of a pallet truck and the article to be wrapped up that is supported by the lifting fork when the article is conveyed onto the cover plate to be supported by it for wrapping, and when it is conveyed off the cover plate after the wrapping. The grooves 3, 4 also comprise side walls which extend between the cover plate 2 and the bottom.

Further, the turntable comprises a base plate 5 which is immovably supported to a fixed base, such as the floor. The cover plate 2 which is to be rotated relative to the base plate 5 is bearing-mounted to rotate about a central vertical rotating axis 6. Extending up substantially perpendicularly from the periphery of the base plate 5 is a vertical wall 7.

The vertical wall 7 comprises three openings 8, 9, 10. An opening 8, 9, 10 refers to a discontinuity in the vertical wall 7, i.e. the opening does not comprise any parts that would protrude from the base plate 5 and prevent thrusting of the pallet truck inside the grooves 3, 4. Similarly, the width of the opening 8, 9, 10 is so fitted that the pallet truck May be thrust freely inside the grooves through the opening. The openings 8, 9, 10 are directed from the rotating axis 6 radially in different directions relative to each other to fit the access ramp 12, 13, 14 selectively in alignment with at least one of the openings 8, 9, 10, so as to selectively determine the approach direction of the pallet truck. The angle $\alpha$ between the radii that extend from the rotating axis 6 through the midpoints of the adjacent openings 8, 9; 8, 10 is about 90°.

The openings comprise a first opening 8, a second opening 9 and a third opening 10, wherein the second opening 9 and the third opening 10 are oriented in opposite directions relative to each other, and the first opening 8 is located to the vertical wall between the second opening 9 and the third opening 10. The first opening 10 is located on the opposite side relative to the rotating mechanism which also functions as a mounting for the tower body of the wrapping machine.

As seen from the figures, the access ramp 12, 13, 14 may be fitted in alignment with any one of the openings 8, 9, 10 and mounted to the vertical wall 7. Through the access ramp 12, 13, 14, the forks of the pallet truck may be conveyed into the grooves 3, 4 of the cover plate when the grooves 3, 4 are aligned with the opening. It is further seen from the figures that the turntable 1 comprises detachably mountable cover wall sections 15, 16 which may be mounted to cover that or those openings 8; 9; 10 which is/are currently not aligned with an access ramp 12, 13, 14.

The vertical wail 7 comprises fixing members 11, in this context bolt holes, on both sides of each opening 8, 9, 10. The cover wall sections 15, 16 and the access ramp 12, 13, 14 comprise corresponding fixing members, such as bolt holes for bolt fixing, to be fitted in alignment with the fixing members 11.

The periphery of the rotatable cover plate 2 comprises a skirt flange 17 that extends down from the level of the cover plate in a substantially vertical direction. The skirt flange 17 that rotates along with the cover plate is disposed in the interior of and is covered by the fixed vertical wall 7 and the cover wall sections 15, 16 mounted to the vertical wall over the unused openings, so that, as the turntable rotates, there is no risk of the workers' feet being contacted with parts of the rotating cover plate from the side.

Figure 2:
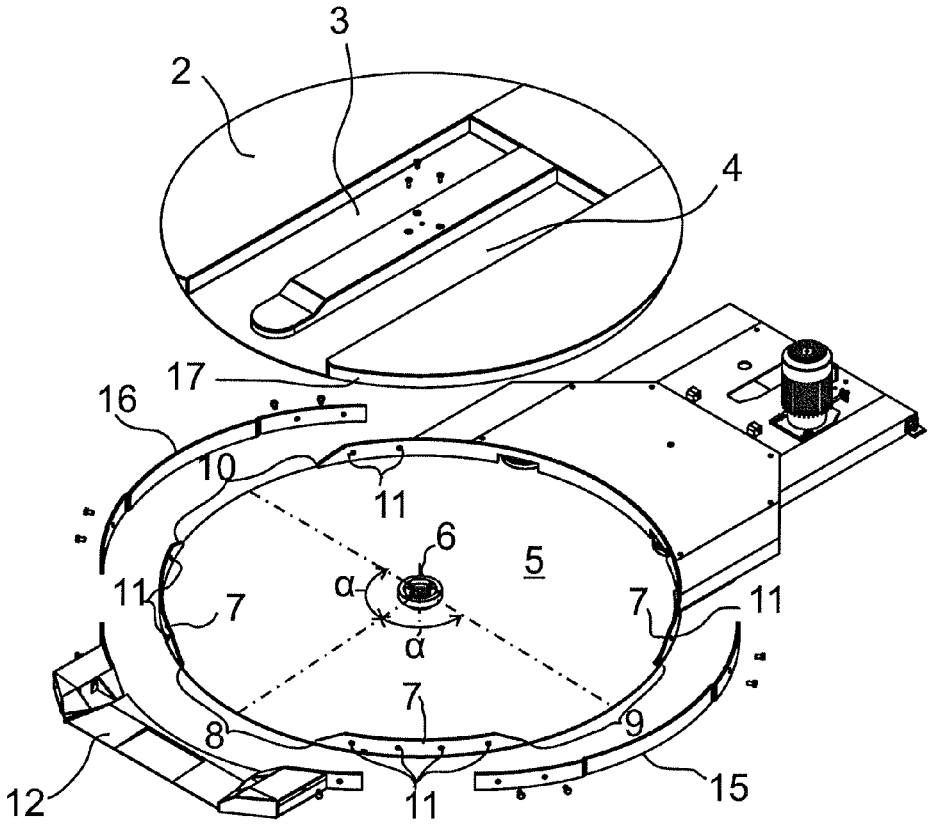

The mounting alternative of FIGS. 1 and 2 uses one access ramp 12 mounted in alignment with the first opening 8. The second opening 9 and the third opening 10 are covered with cover wall sections 15 and 16.

Figure 3:
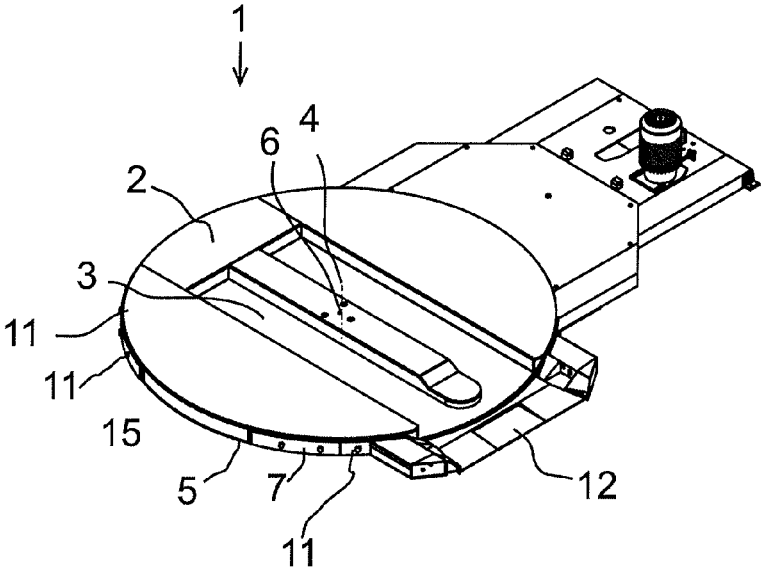
Figure 4:
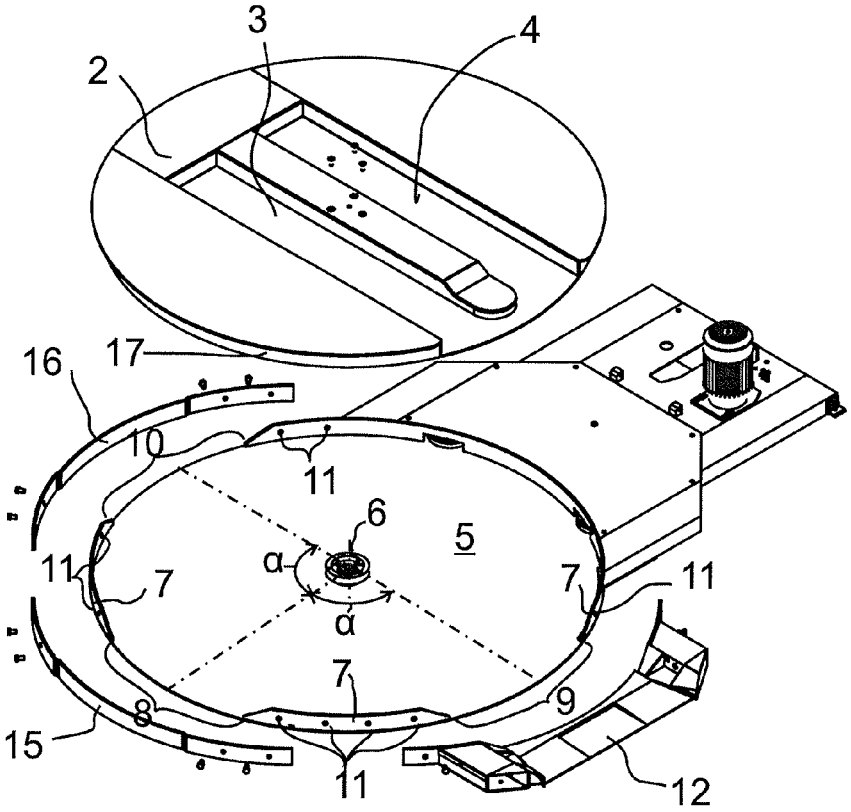

In the mounting alternative of FIGS. 3 and 4, the access ramp 12 is mounted in alignment with the second opening 9. The first opening 8 and the third opening 10 are covered with cover wall sections 15 and 16.

Figure 5:
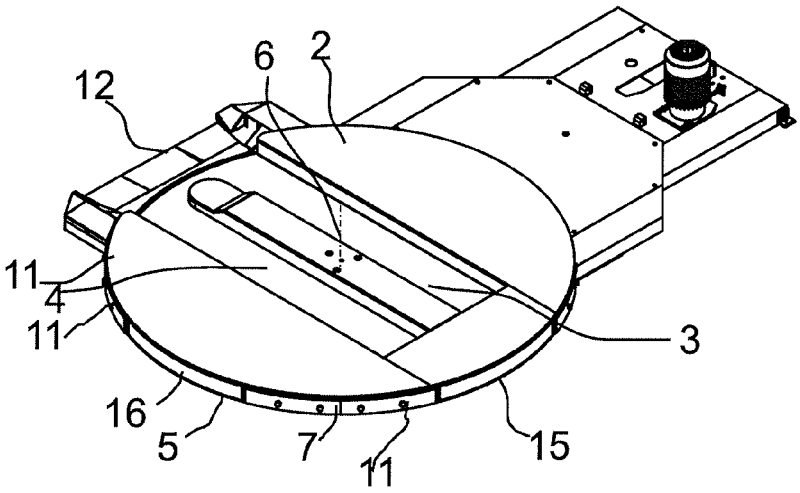
Figure 6:
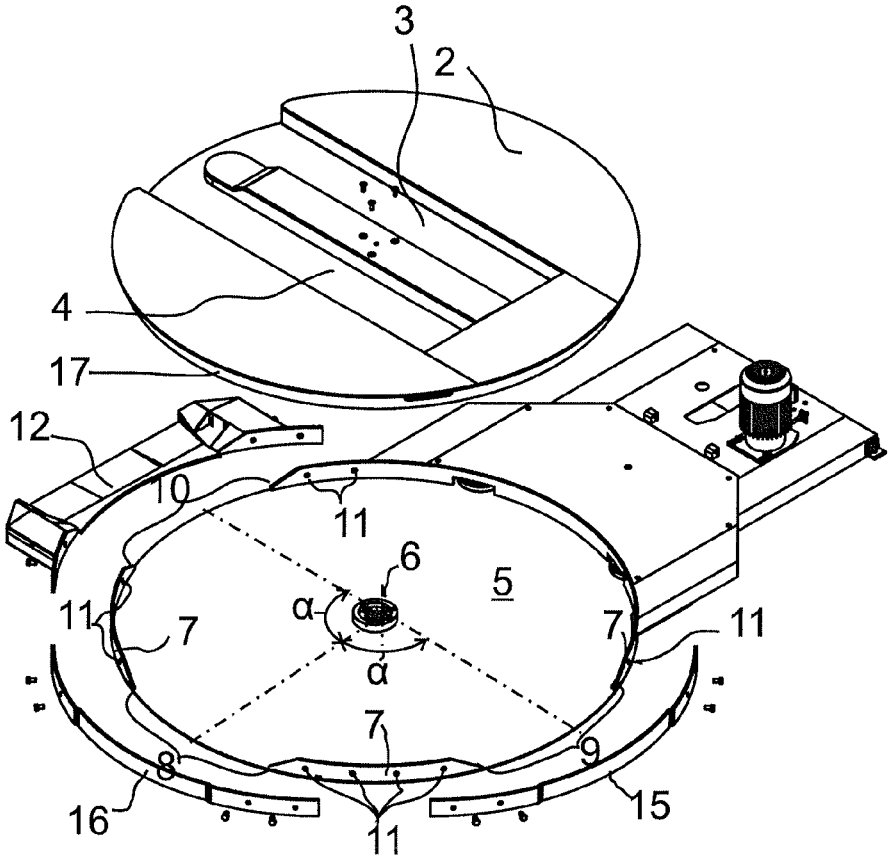

In the mounting alternative of FIGS. 5 and 6, one access ramp 12 is mounted in alignment with the third opening 10. The first opening 8 and the second opening 9 are covered with cover wall sections 15 and 16.

Figure 7:
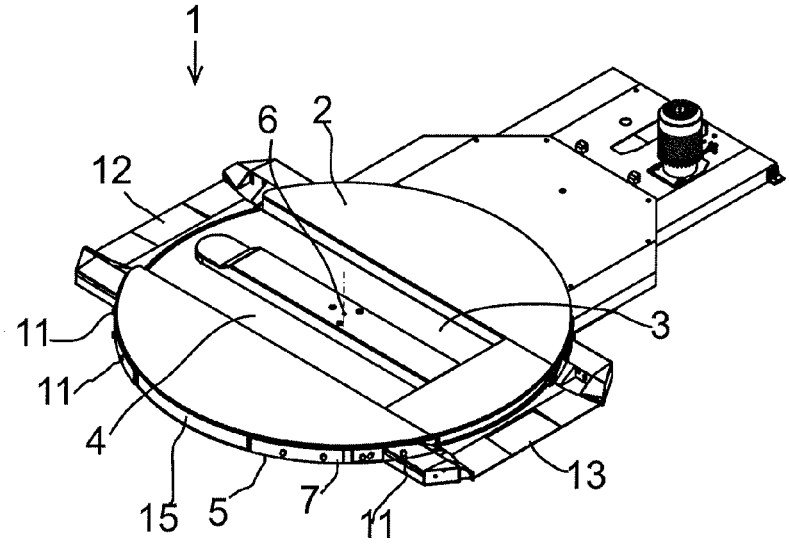
Figure 8:
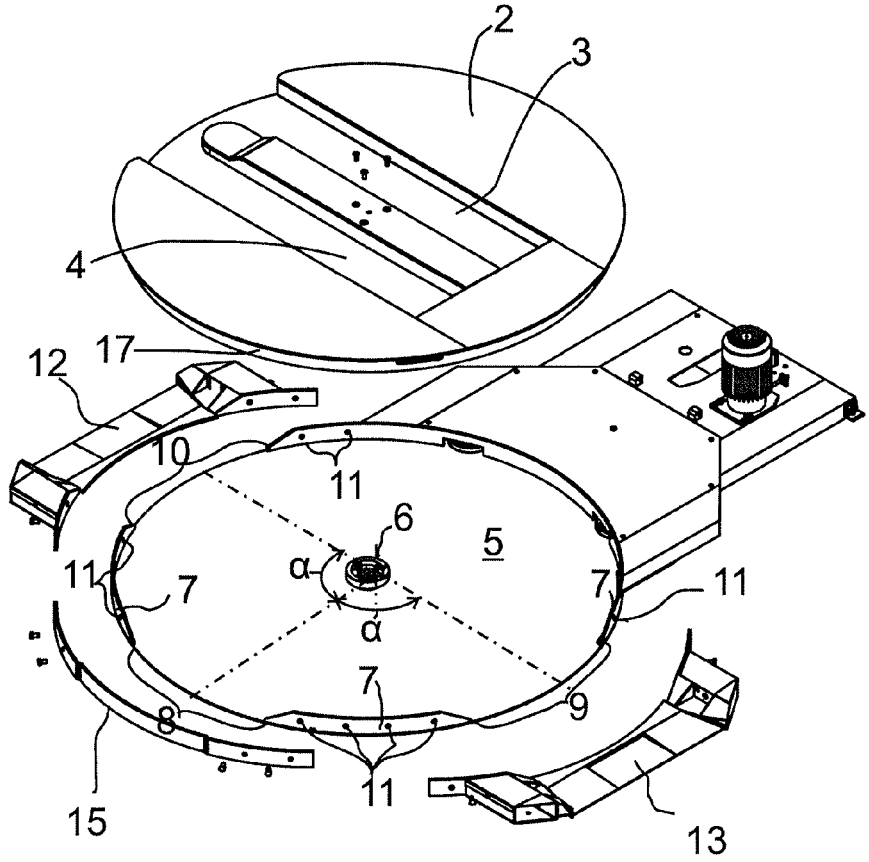

The mounting alternative of FIGS. 7 and 8 uses two access ramps 12, 13 mounted in alignment with the second opening and the third opening 10. The first opening 8 is covered with the cover wall section 15.

Figure 9:
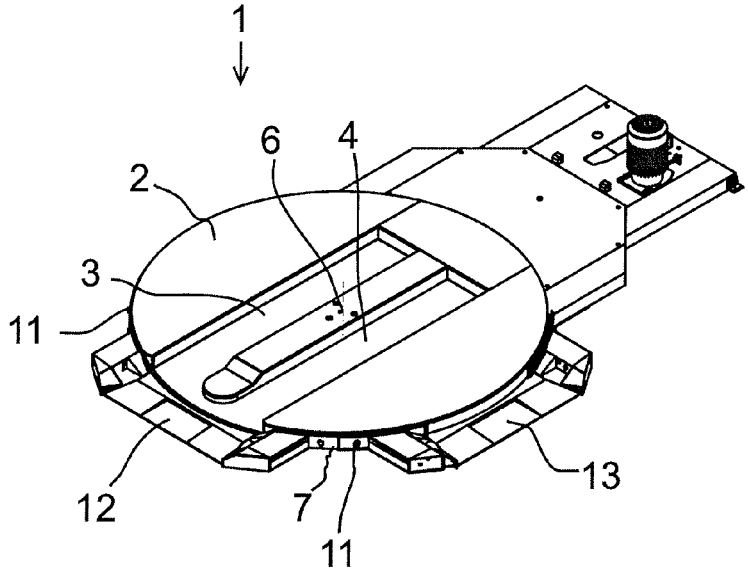
Figure 10:
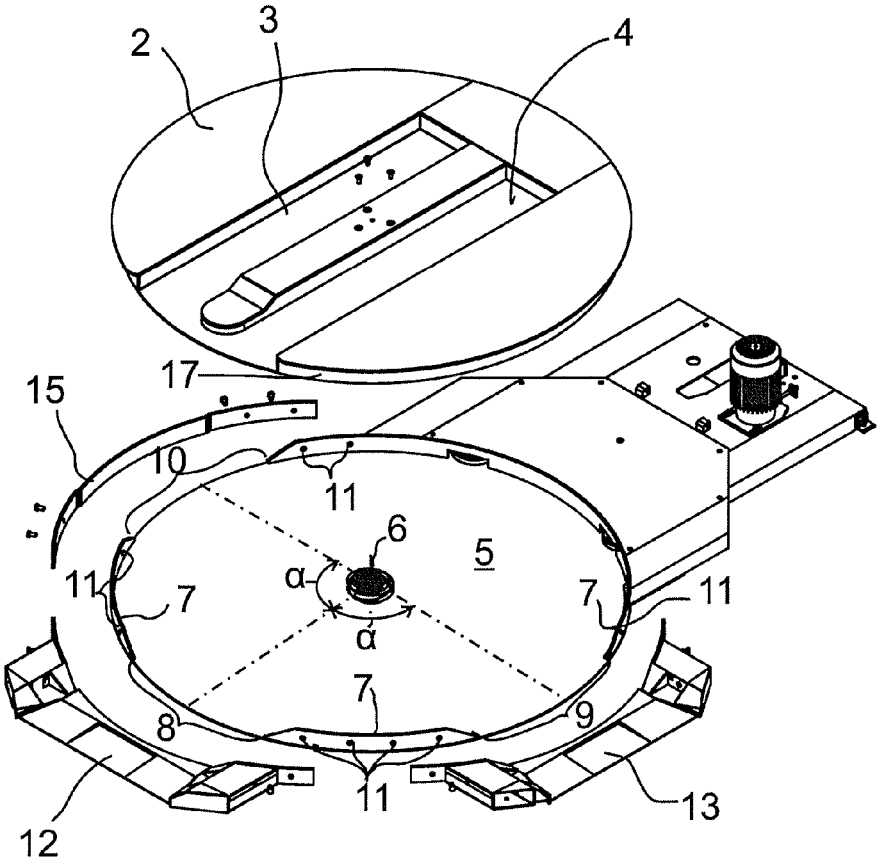

In the mounting alternative of FIGS. 9 and 10, the first access ramp 12 is mounted in alignment with the first opening 8 and the second access ramp 13 is mounted in alignment with the second opening 9. The third opening 10 is covered with the cover wall section 15.

In the mounting alternative of FIGS. 11 and 12, the first access ramp 12 is mounted in alignment with the first opening 8 and the second access ramp 13 is mounted in alignment with the third opening 9. The second opening 9 is covered with the cover wall section 15.

In the mounting alternative of FIGS. 13 and 14, the first access ramp 12 is mounted in alignment with the first opening 8, the second access ramp 13 is mounted in alignment with the third opening 10, and the third access ramp 14 is mounted in alignment with the second opening 9.

In the case where the turntable is provided with two or three access ramps, the site at which the cover plate stops may be selected as desired by suitably controlling the rotating mechanism of the turntable, so that the grooves 3, 4 are aligned with that access ramp which corresponds to the direction of the access ramp from which the turntable is being approached. The control may also be provided through a type of remote control, so that the person who is conveying the articles to be wrapped up to the turntable by the pallet truck, or a control unit installed in the pallet truck, may perform the above-mentioned selection. Alternatively, a control unit installed in the turntable may be arranged to recognize the current approach direction so that it may command the cover plate to rotate in a suitable direction.

The invention is not limited merely to the examples of its embodiments referred to above; instead, many variations are possible within the scope of the inventive idea defined by the claims.

The invention claimed is:

1. A turntable for a wrapping machine for rotating an article to be wrapped up, the turntable comprising a rotatable round cover plate comprising two grooves in parallel with each other and arranged at a distance from each other, wherein the grooves extend from the edge of the cover plate on both sides of the diameter of the cover plate and in parallel to the diameter, and wherein the grooves are adapted to receive the forks of the lifting fork so that the article to be wrapped up can be conveyed by the pallet truck onto the cover plate to be supported by it, and respectively off the cover plate, a base plate which is immovably supported to a fixed base, wherein the cover plate which is to be rotated relative to the base plate is bearing-mounted to rotate about a central vertical rotating axis, a vertical wall substantially perpendicularly on the periphery of the base plate, wherein the vertical wall comprises an opening, an access ramp fitted in alignment with the opening and mounted to the vertical wall so that the forks of the lifting fork can be conveyed to the grooves of the cover plate through the access ramp, characterized in that the vertical wall comprises at least two openings directed from the rotating axis radially in different directions from each other to fit the access ramp selectively in alignment with at least one of the openings, so as to selectively determine the approach direction of the pallet truck.

2. The turntable according to claim 1, characterized in that the vertical wall comprises three openings.

3. The turntable according to claim 2, characterized in that the turntable comprises two access ramps.

4. The turntable according to claim 2, characterized in that the turntable comprises three access ramps.

5. The turntable according to claim 1, characterized in that the angle ($\alpha$) between the radii that extend from the rotating axis through the midpoints of the adjacent openings is about 90°.

6. The turntable according to claim 1, characterized in that the turntable comprises detachably mountable cover wall sections which can be fitted to cover that or those openings which is/are Previously not aligned with an access ramp.

7. The turntable according to claim 1, characterized in that the vertical wall comprises fixing members, such as bolt holes, on both sides of the opening; and that the cover wall section and the access ramp comprise corresponding fixing members, such as bolt holes for bolt fixing, fitted in alignment with the fixing members.

8. The turntable according to claim 6, characterized in that the periphery of the rotatable cover plate comprises a skirt flange that extends down from the level of the cover plate in a substantially vertical direction; and that the skirt flange which rotates with the cover plate is disposed in the interior of and is covered by the fixed vertical wall and the optional cover wall sections mounted to the vertical wall.

9. The turntable according to claim 1, wherein the vertical wall extends up from the base plate.

10. A turntable for a wrapping machine for rotating an article to be wrapped up, the turntable comprising a top platform including two grooves in parallel with each other and arranged at a distance from each other, wherein the grooves extend from the edge of the top platform and in parallel, and wherein the grooves are adapted to receive forks of a lifting fork so that the article to be wrapped up can be conveyed by a pallet truck onto the top platform to be supported by it, and respectively off the top platform;

a base structure, wherein the turntable is configured such that the top platform is configured to be rotated relative to the base;

a vertical wall substantially perpendicularly on the periphery of the base structure, wherein the vertical wall comprises a plurality of openings, wherein structure of the turntable in fixed relationship with the top platform is located inside of a boundary established by the vertical wall, at least a portion of the structure forming the two grooves such that channels of the grooves extend below tops of the vertical wall; and an access ramp fitted in alignment with at least one of the openings and mounted to the vertical wall so that the forks of the lifting fork can be conveyed to the grooves of the cover plate via the access ramp, wherein a longitudinal end of respective grooves is aligned with the openings such that the forks of the lifting fork can be conveyed into the grooves from below the top surface of the vertical wall, and wherein the turntable is configured such that the access ramp can be moved into alignment with another of the openings and mounted to the vertical wall at another location so that the forks of the lifting fork can be conveyed to the grooves of the cover plate via the access ramp mounted at the another location, wherein upon rotation of the platform, the longitudinal end of respective grooves is aligned with the another of the openings such that the forks of the lifting fork can be conveyed into the grooves from below the top surface of the vertical wall at the another location.

11. The turntable according to claim 10, wherein the vertical wall comprises three openings.

12. The turntable according to claim 11, wherein the turntable comprises two access ramps.

13. The turntable according to claim 11, wherein the turntable comprises three access ramps.

14. The turntable according to claim 10, wherein the angle ($\alpha$) between the radii that extend from a rotating axis of the top platform through the midpoints of the openings is about 90°.

15. The turntable according to claim 10, wherein the turntable comprises detachably mountable cover wall sections which can be fitted to cover that or those openings which is/are previously not aligned with an access ramp.

16. The turntable according to claim 10, wherein the periphery of the top platform comprises a skirt flange that extends down from a level of a top surface of the top platform in a substantially vertical direction, and wherein the skirt flange which rotates with the top platform is disposed in the interior of and is covered by the vertical wall.

17. The turntable of claim 1, wherein at least one opening is open to an outer perimeter of the turntable lying on a plane normal to the rotation axis.

18. The turntable of claim 10, wherein at least one opening is open to an outer perimeter of the turntable lying on a plane normal to a rotation axis of the to platform.

19. The turntable of claim 1, wherein structure of the turntable in fixed relationship with the cover plate is located inside of a boundary established by the vertical wall, the structure extending below a top of the vertical wall, the structure forming the two grooves such that channels of the grooves extend below tops of the vertical wall.

20. The turntable of claim 10, wherein the grooves of the top platform extend substantially the entire thickness of the structure making up and/or fixed to the top platform.

* * * * *